US006342866B1

(12) United States Patent
Ho et al.

(10) Patent No.: US 6,342,866 B1
(45) Date of Patent: Jan. 29, 2002

(54) WIDEBAND ANTENNA SYSTEM

(75) Inventors: Thinh Q. Ho, Anaheim; Stephen M. Hart; Richard C. Adams, both of San Diego, all of CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/527,152

(22) Filed: Mar. 17, 2000

(51) Int. Cl.[7] ..... H01Q 1/36
(52) U.S. Cl. ..... 343/795; 343/853; 343/909
(58) Field of Search ..... 343/795, 700 MS, 343/810, 807, 853, 844, 909, 824, 826, 829, 846, 848; H01Q 21/20

(56) References Cited

U.S. PATENT DOCUMENTS

| | | | | |
|---|---|---|---|---|
| 3,745,583 A | | 7/1973 | Herbert | |
| 3,754,269 A | | 8/1973 | Clavin et al. | |
| 3,942,180 A | | 3/1976 | Rannou et al. | |
| 4,323,900 A | | 4/1982 | Krall et al. | |
| 4,605,932 A | * | 8/1986 | Butscher et al. | 343/700 MS |
| 4,835,542 A | | 5/1989 | Sikina, Jr. | |
| 4,943,811 A | * | 7/1990 | Alden et al. | 343/810 |
| 5,418,544 A | * | 5/1995 | Elliot | 343/810 |
| 5,517,206 A | | 5/1996 | Boone et al. | |
| 5,534,880 A | | 7/1996 | Button et al. | |
| 5,600,340 A | | 2/1997 | Ho et al. | |
| 6,147,572 A | * | 11/2000 | Kaminski et al. | 343/909 |

* cited by examiner

*Primary Examiner*—Michael C. Wimer
(74) *Attorney, Agent, or Firm*—Harvey Fendelman; Peter A. Lipovsky; Michael A. Kagan

(57) ABSTRACT

A wideband antenna system comprises a stack of m antennas, where m is a positive integer, and m≧2. Each antenna includes: a) an electrically insulating substrate; b) opposed first and second radio frequency elements mounted to the substrate; c) a ground feed electrically connected to the first radio frequency element; d) an excitation feed electrically connected to the second radio frequency element; and e) a ground plane mounted to the substrate of the $m^{th}$ antenna. The radio frequency elements of each antenna collectively have a unique total area and are mounted to the electrically insulating substrate. The radio frequency elements of the $i^{th}$ antenna provide a ground plane for the $k^{th}$ antenna, where i and k are positive integers, 1≦k≦(i−1), and 2≦i≦m. The total area of the first and second radio frequency elements of the $i^{th}$ antenna is greater than the total area of the first and second radio frequency elements of the $k^{th}$ antenna.

7 Claims, 7 Drawing Sheets

WIDEBAND ANTENNA SYSTEM

BACKGROUND OF THE INVENTION

The present invention generally relates to the field of radio frequency antennas, and more particularly to an antenna system that incorporates a stack of overlying dual element antennas in a single structure so that the bandwidth of the antenna system is the sum of the bandwidths of all the individual antennas.

A dipole antenna generally has about 20% bandwidth, depending on its actual configuration. Multiple bandwidth performance is conventionally achieved by employing separate dipole antennas that each cover a specific portion of the radio frequency spectrum. However, separate dipole antennas collectively tend to be bulky. Shipboard communications systems generally require multiple bandwidth performance. However, multiple antenna systems on board ships must compete for a very limited amount of space. Therefore, there is a strong need for an antenna system that provides multiple bandwidth performance in a compact package.

SUMMARY OF THE INVENTION

The present invention provides a wideband antenna system incorporates a stack of m antennas, $A_i$, where i is an index from 1 to m, m and i are positive integers, and $m \geqq 2$. Each antenna $A_i$ includes: an electrically insulating substrate; opposed radio frequency elements mounted to the electrically insulating substrate such that the radio frequency elements of the antennas $A_2$ through $A_m$ provide ground planes for antennas $A_1$ through $A_{m-1}$; and a ground plane mounted to the substrate for antenna $A_m$. In other words, each underlying antenna $A_i$ provides a ground plane for the immediately overlying antennas. The bandwidth of the antenna system is generally the sum of the bandwidths of the individual antennas, thereby providing the antenna system with wideband performance characteristics in a compact package. However, it is to be understood that some of the bandwidths of the individual antennas may be continuous, overlapping, spaced apart, or some combination of the foregoing. The antenna system may also incorporate a frequency selective surface so that the antenna system is limited to detecting RF signals having particular bandwidth characteristics.

The invention may also be characterized as a wideband antenna system that comprises a stack of m antennas, where m is a positive integer, and $m \geqq 2$. Each antenna includes: a) an electrically insulating substrate: b) opposed first and second radio frequency elements mounted to the substrate: c) a ground feed electrically connected to the first radio frequency element: d) an excitation feed electrically connected to the second radio frequency element: and e) a ground plane mounted to the substrate of the $m^{th}$ antenna. The radio frequency elements of each antenna collectively have a unique total area and are mounted to the electrically insulating substrate. The radio frequency elements of the $i^{th}$ antenna provide a ground plane for the $k^{th}$ antenna, where i and k are positive integers $1 \leqq k \leqq (i-1)$ and $2 \leqq i \leqq m$. The total area of the first and second radio frequency elements of the $i^{th}$ antenna is greater than the total area of the first and second radio frequency elements of the $k^{th}$ antenna.

In another embodiment of the invention, antenna stacks may be radially distributed about an arcuate shaped structure such as a tube so that each stack has a unique field of view. This configuration allows the antenna system to detect or transmit RF signals to some or all of a broad region without having to rotate the antenna.

These and other advantages of the invention will become more apparent upon review of the accompanying drawings and specification, including the claims.

BRIEF DESCRIPTION OF THE DRAWINGS

Throughout the several view, like elements are referenced using like references.

DESCRIPTION OF THE PREFERRED EMBODIMENT

Figure 1:
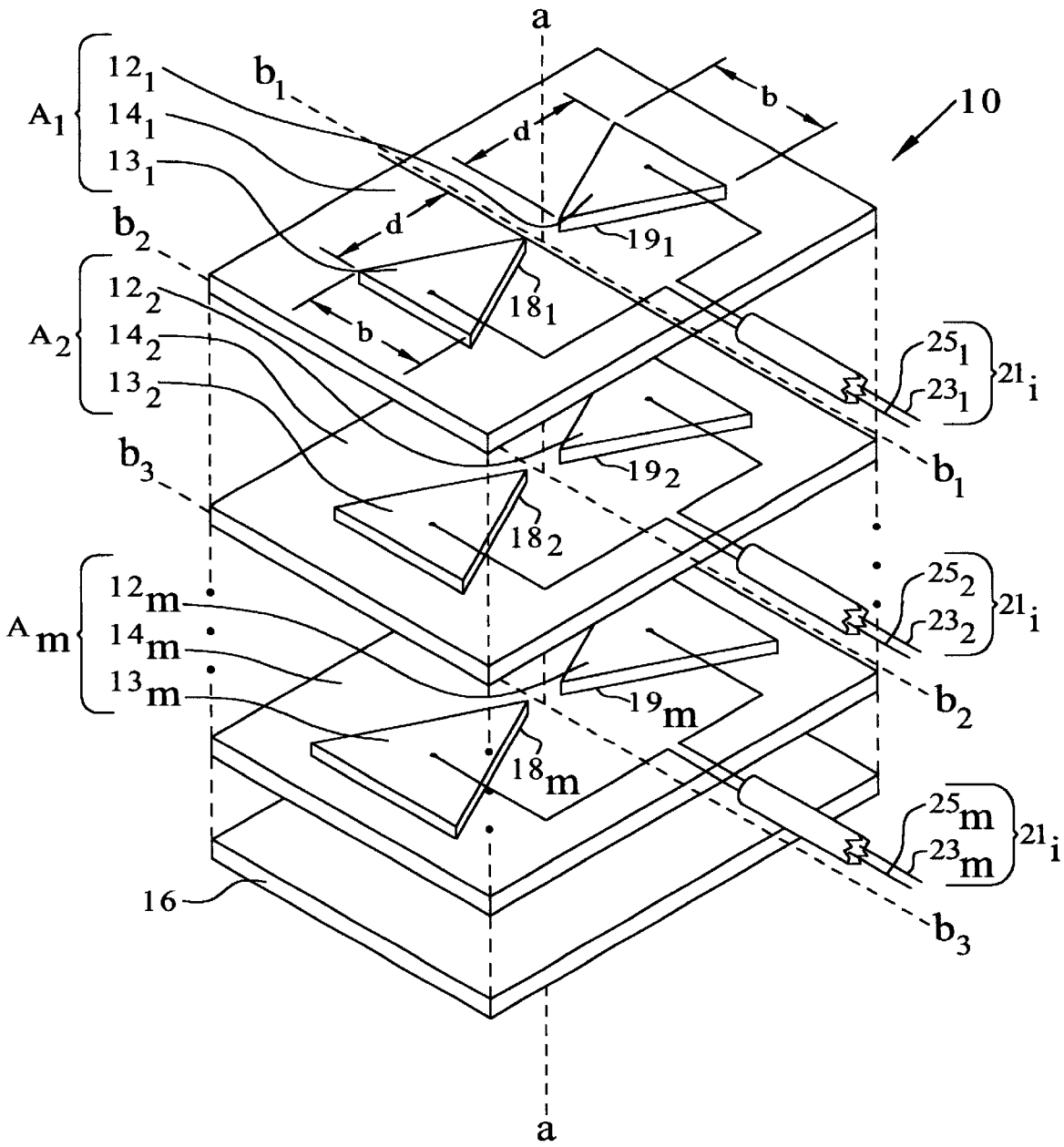
FIG. 1 illustrates an exploded view of a wideband antenna embodying various features of the present invention.

Referring to FIG. 1, the present invention is directed to a wideband antenna system 10 that incorporates a stack of dual element antennas $A_i$ each having a particular bandwidth, where i is an index from 1 to m, m is a positive integer, and $m \geqq 2$. The overall bandwith of antenna system 10 is generally the sum of the bandwidths of each of the individual dual element antennas $A_i$. Each antenna $A_i$ includes an electrically insulating substrate $\mathbf{14}_i$ and a pair of two diametrically opposed and preferably symmetrical radio frequency elements $\mathbf{12}_i$ and $\mathbf{13}_i$ mounted to one side of insulating substrate $\mathbf{14}_i$. An important feature of the invention is that radio frequency element pairs $\mathbf{12}_2/\mathbf{13}_2$ through $\mathbf{12}_m/\mathbf{13}_m$ of antennas $A_2$ through $A_m$ ground planes for antennas $A_1$ through $A_{m-1}$. Radio frequency elements $\mathbf{12}_i$ and $\mathbf{13}_i$ transform radio frequency (RF) energy into an electrical signal and/or transform an electrical signal into radiated radio frequency energy. A radio frequency (RF) ground plane 16, preferably made of an electrically conductive metallic material, is mounted to substrate $\mathbf{14}_m$ of antenna $A_m$ on a side opposite the side on which radio frequency element pairs $\mathbf{12}_m/\mathbf{13}_m$ are mounted. Substrates $\mathbf{14}_i$ are preferably implemented as electrically non-conductive materials and/or material systems such as fiberglass, phenolic, S-glass, and E-glass, and may have a thickness in the range of about 0.1 to 20 mm, depending on the desired frequency response.

Figure 2:
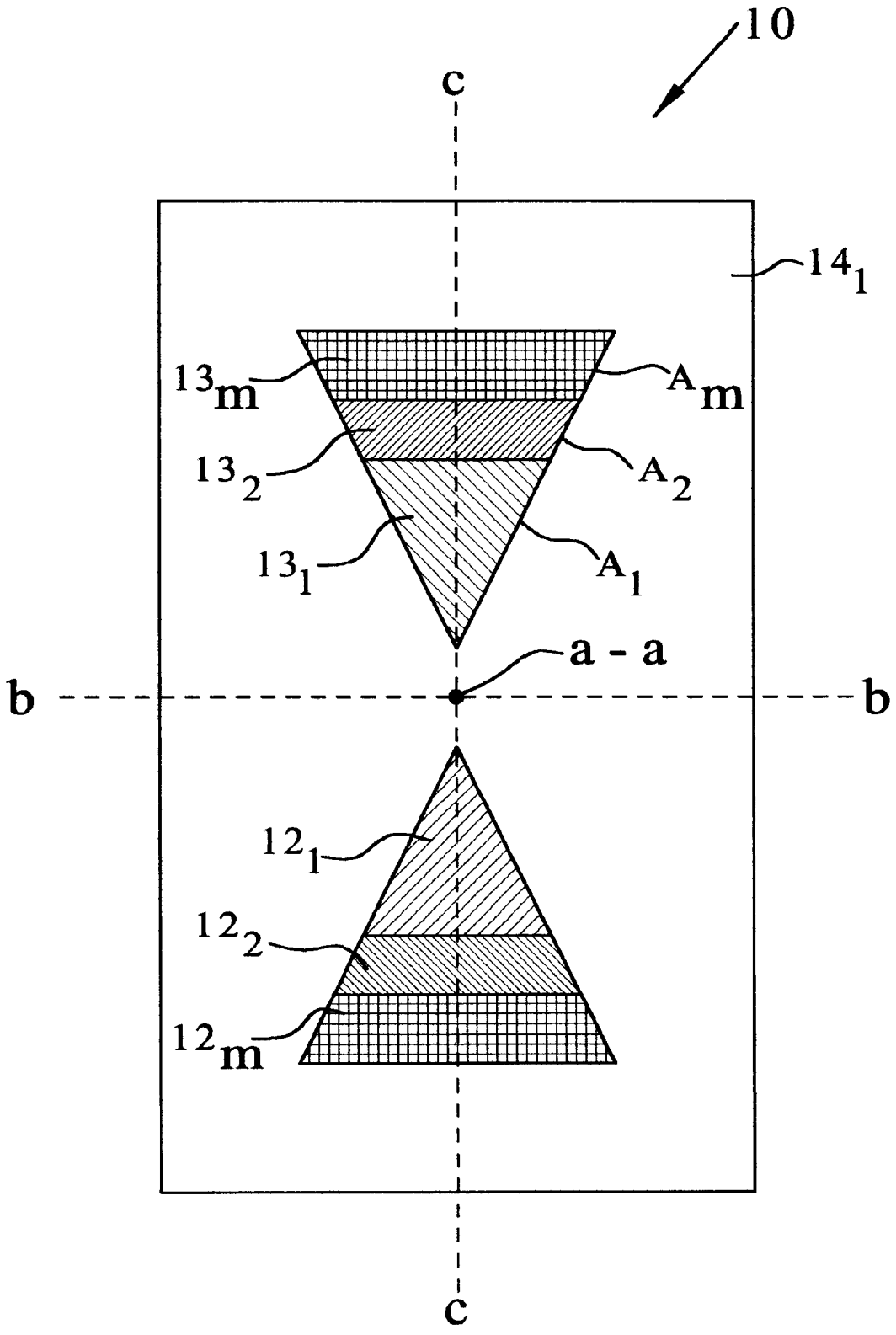
FIG. 2 illustrates a cutaway view of the wideband antenna shown in FIG. 1.
Figure 3:
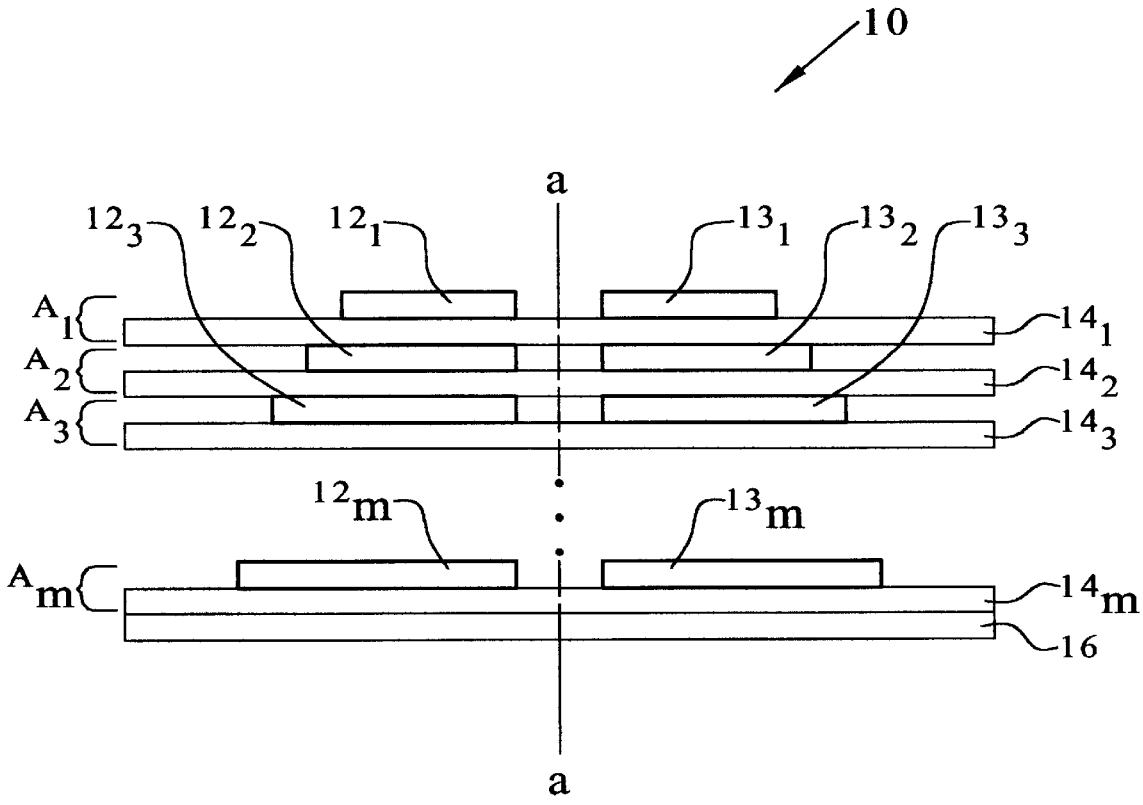
FIG. 3 is a side view of the wideband antenna shown in FIG. 1.

Antennas $A_i$ are stacked as shown in FIGS. 1–3 to form antenna system 10 having an overall bandwidth determined by the bandwidths of each of antennas $A_1$ through $A_m$. Thus, antenna system 10 may be characterized as a wideband antenna, where a wideband antenna is an antenna system having a bandwidth that is determined by the bandwidths of all the individual dual element antennas $A_i$ that comprise antenna system 10. Stacked antennas $A_i$ may be held together using conventional methods such as adhesive or mechanical fasteners, not shown. By way of example, in FIGS. 1 and 2, radio frequency element pairs $\mathbf{12}_i/\mathbf{13}_i$ preferably each are shaped as symmetrically opposed, isosceles triangles such that antennas $A_i$ define bow-tie antennas.

However, it is to be understood that radio frequency element pairs $\mathbf{12}_i/\mathbf{13}_i$ may have other linearly tapered shapes as well to enhance the impedance match of the antenna with respect to feed $\mathbf{21}_i$ over a broad bandwidth. A broad bandwidth may be in the range of about 100 MHz to 20 GHz. Each feed $\mathbf{21}_i$ includes an excitation line feed $\mathbf{23}_i$ electrically connected to each of radio frequency elements $\mathbf{12}_i$ and a ground feed $\mathbf{25}_i$ electrically connected to each of radio frequency elements $\mathbf{13}_i$. Ground feed $\mathbf{25}_i$ provides a ground with respect to excitation line feed $\mathbf{23}_i$. Byway of example, each feed $\mathbf{21}_i$ maybe implemented as coaxial cable.

Radio frequency elements $\mathbf{12}_i$ and $\mathbf{13}_i$ have an apex $\mathbf{18}_i$ and $\mathbf{19}_i$, respectively, and are positioned so that they are diametrically opposed and symmetrical about the intersection of orthogonal axes a—a and axis $b_i$—$b_i$. Radio frequency elements $\mathbf{12}_i$ and $\mathbf{13}_i$ are generally made of an electrically conductive material or material system that includes copper, aluminum, gold, or other electrically conductive materials, and are mounted to one side of substrate $\mathbf{14}_i$. Each substrate $\mathbf{14}_i$ may have a thickness, for example, in the range of about 0.1–20 mm.

As shown in FIGS. 1–3, radio frequency element pairs $\mathbf{12}_2/\mathbf{13}_2$ through $\mathbf{12}_m/\mathbf{13}_m$ of antennas $A_2$ through $A_m$ overlie and thereby provide ground planes for radio frequency element pairs pairs $\mathbf{12}_1/\mathbf{13}_1$ through $\mathbf{12}_{m-1}/\mathbf{13}_{m-1}$. FIGS. 2 and 3 are cross-sectional and cut-away views of antenna system 10 that further show antenna elements $\mathbf{12}_k/\mathbf{13}_k$ underlying antenna elements $\mathbf{12}_i/\mathbf{13}_i$, respectively, where i and k are positive integer indices, $1 \leqq i \leqq (m-1)$, and $2 \leqq k \leqq m$. Exemplary dimensions of one pair of radio frequency elements $\mathbf{12}_i$ and $\mathbf{13}_i$ when implemented as isoceles triangles are $b=\lambda/4$ and $d=\lambda/4$, where $\lambda$ represents the center frequency of a specific antenna of antennas $A_i$. The thickness of radio frequency elements $\mathbf{12}_i$ and $\mathbf{13}_i$ is not critical, but maybe in the range of 0.1 to 20 mm. In general, the bandwidth of a bow-tie antenna such as antenna $A_1$ is approximately ±10 per cent of the center frequency, $c/\lambda$, where c represents the speed of light. If for example, antenna $A_1$ is to have a center frequency of 200 MHz, then $b \approx \lambda/4$ (0.375 m) and $d \approx \lambda/4$ (0.375 m), thereby providing antenna $A_1$ with a bandwidth of approximately ±10% of 200 MHz, or ±20 MHz.

Figure 4:
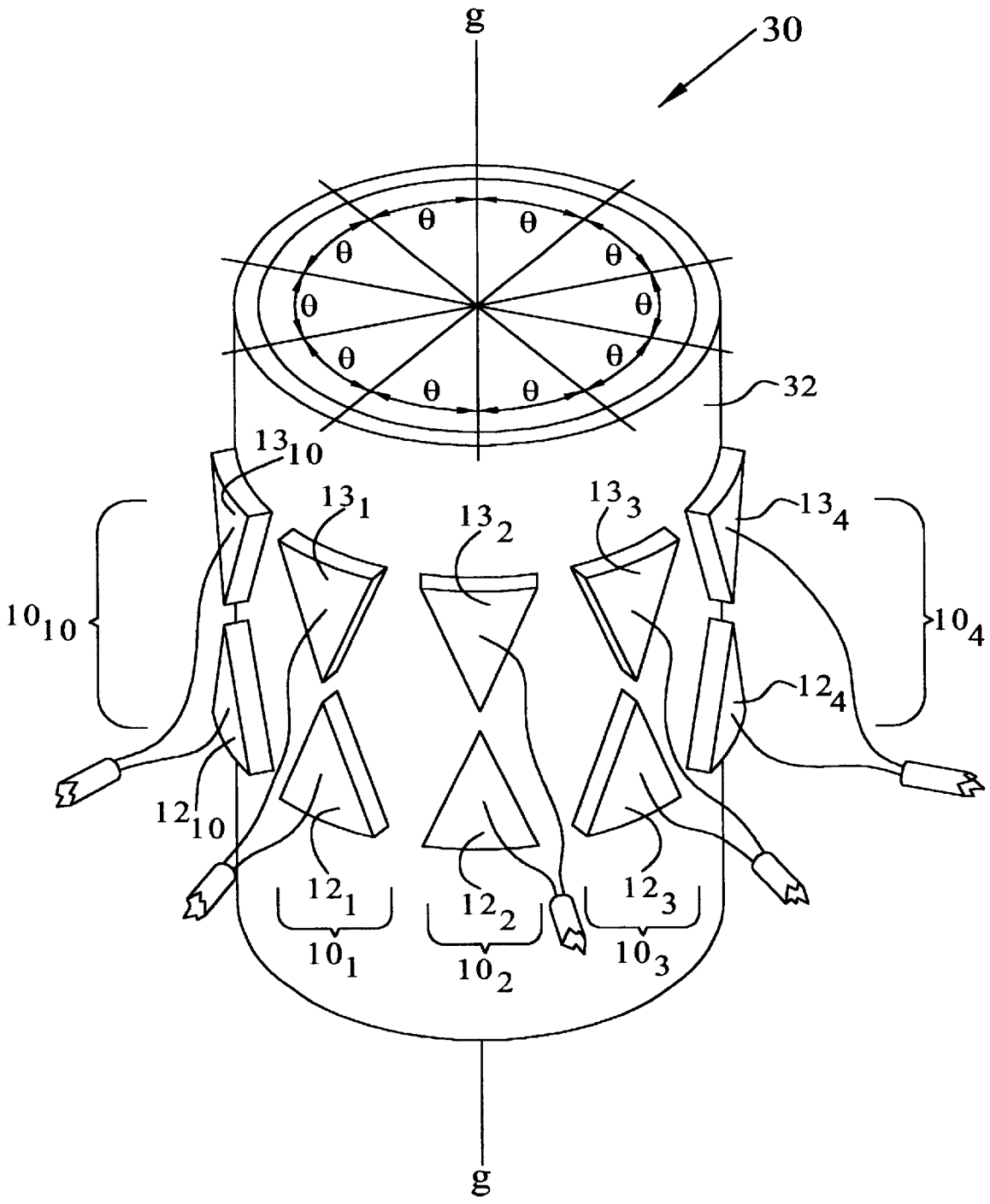
FIG. 4 is a perspective view of an omnidirectional antenna the incorporated multiple wideband antennas of the type shown in FIG. 1.
Figure 5:
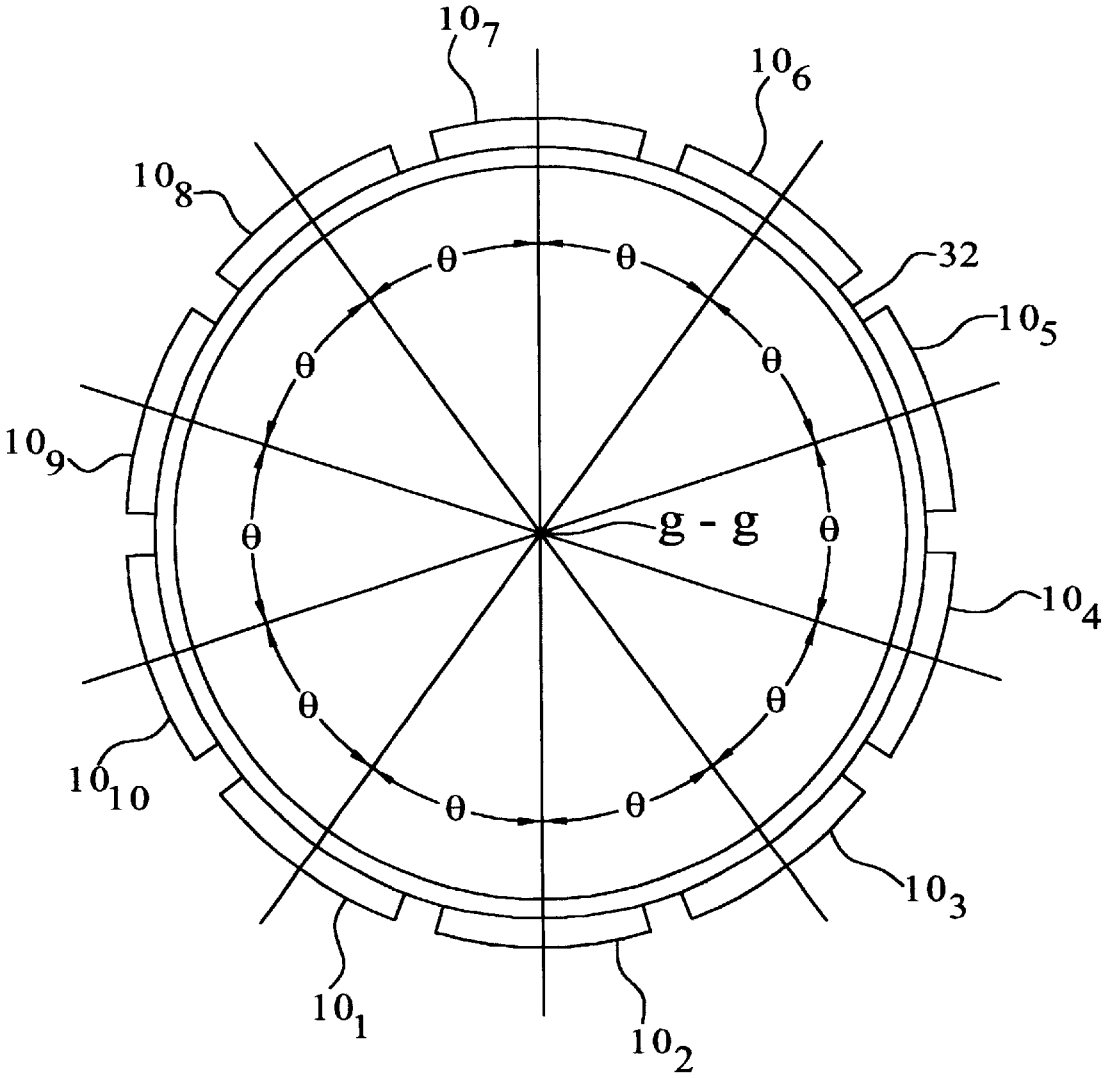
FIG. 5 is a top view of the omnidirectional antenna of FIG. 4 showing the angular distribution of the stacked antenna systems.

Another embodiment of the invention is an antenna array 30 that incorporates multiple antenna systems $\mathbf{10}_j$, where $1 \leqq j \leqq M$, and j is an index from 1 to M, $M \geqq 2$, and j and M are positive integers. Antenna systems $\mathbf{10}_j$ may be configured into an array radially distributed about axis g—g at an angle θ about an arcuate or circular structure 32 as shown in FIGS. 4 and 5, where $\theta=360°/M$. Each of antennas $\mathbf{10}_j$ may be constructed as described above with reference to antenna system 10 and affixed to circular structure 32 using well known fabrication techniques such as adhesives, mechanical fasteners, bonding agents, and the like. Circular structure 32 may be implemented as a tube and be made of an electrically non-conductive material such as fiberglass, S-glass, and E-glass. An important advantage in having antennas $\mathbf{10}_i$ radially distributed about structure 32 is that each individual antenna $\mathbf{10}_i$ has a unique field of view. Thus, antenna system 30 may detect RF signals from or transmit RF signals to a broad region without having to rotate the antenna.

Antenna system 30 is shown, for example, in FIGS. 4 and 5 to include 10 antennas $\mathbf{10}_j$ (j=1, 2, 3, . . . 10). However, it is to be understood that antenna system 30 may be constructed to include any integral number of antennas $\mathbf{10}_i$ required to suit the requirements of a particular application. Further, M may be an odd or even integer that is equal to or greater than two.

Figure 6:
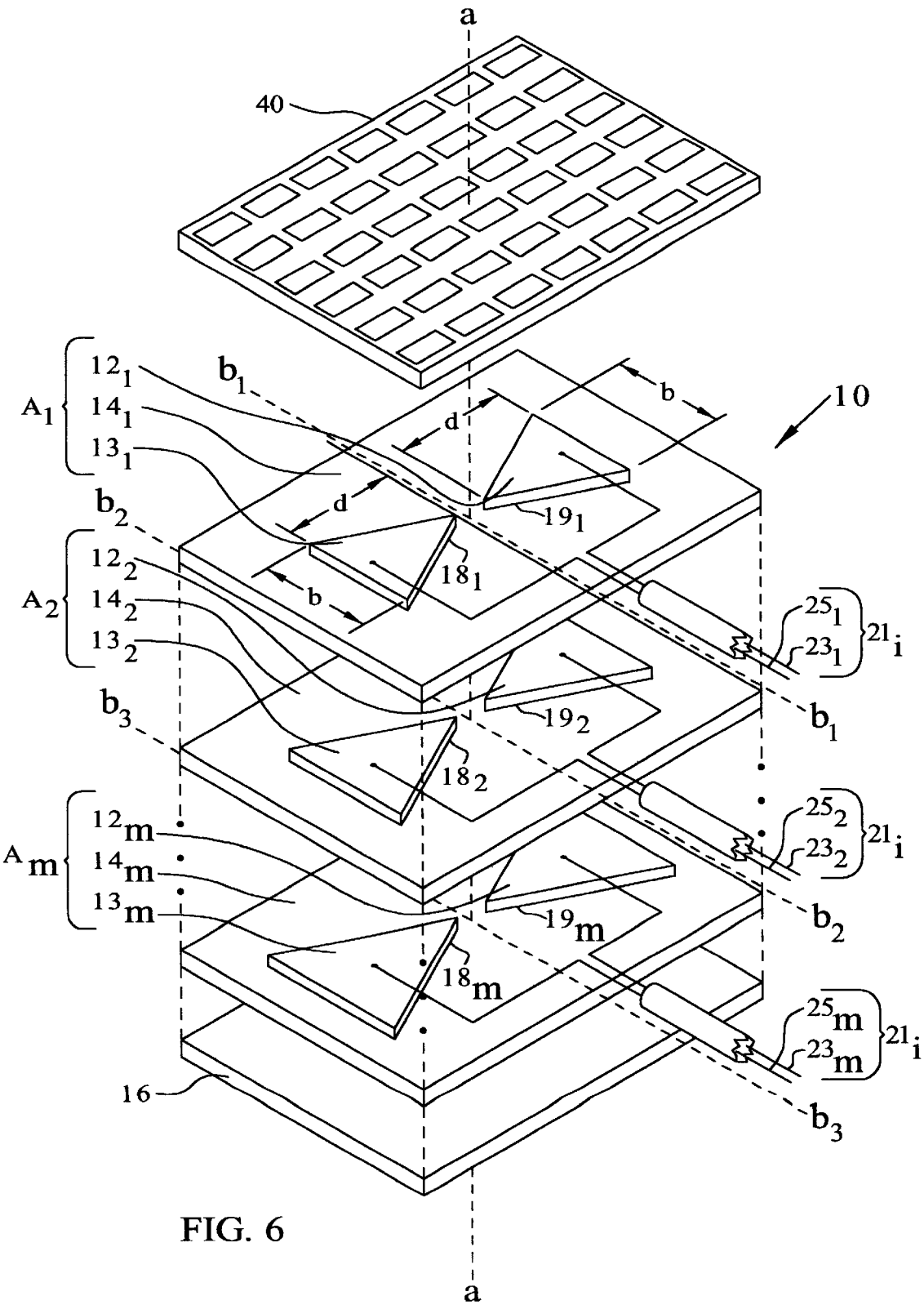
FIG. 6 shows a frequency selective surface incorporated into the antenna system of FIG. 1.

As shown in FIG. 6, antenna system 10 may further include a frequency selective surface (FSS) 40 to filter RF signals so that only signals having particular wavelength characteristics may be received by antenna system 10. Examples of FSS 40 suitable for use in conjunction with the present invention are described in commonly assigned U.S. Pat. No. 5,917,458, incorporated herein by reference.

Figure 7:
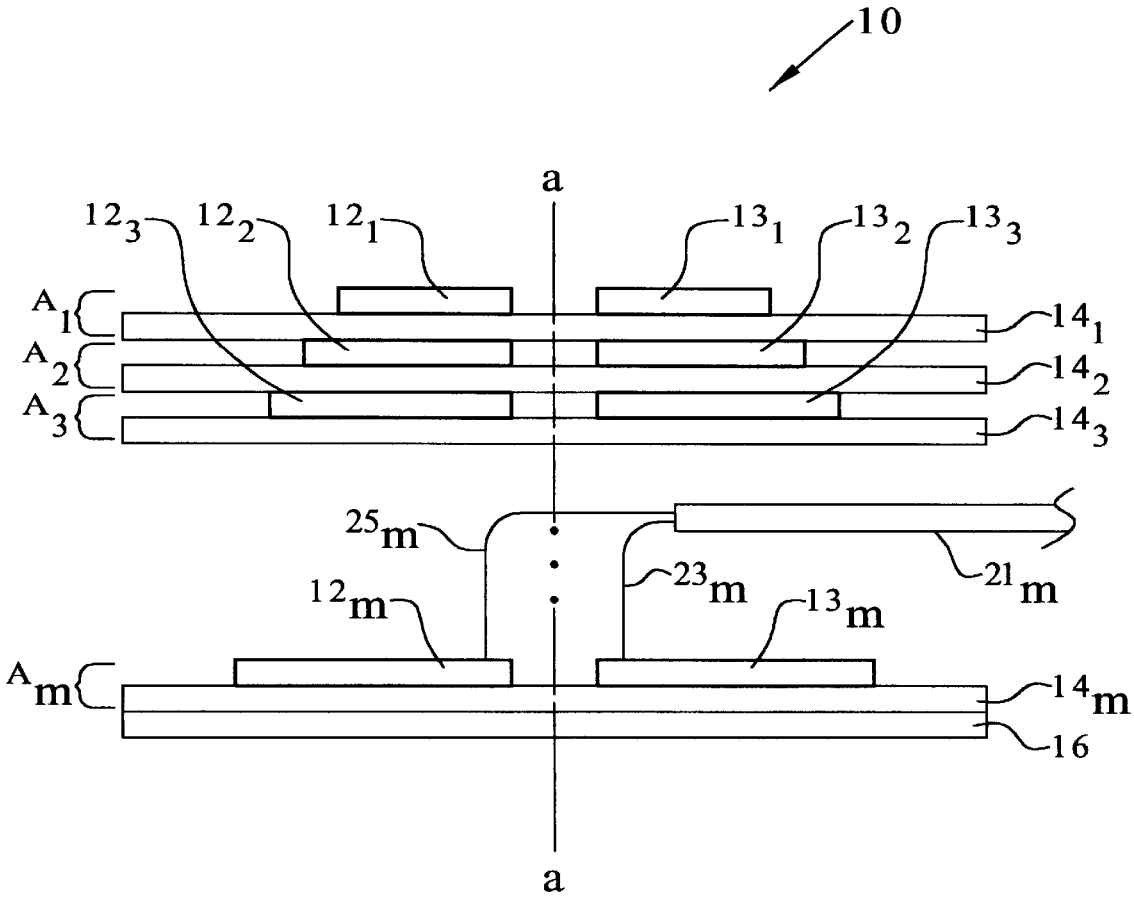
FIG. 7 is a cross-sectional view of the a wideband antenna system that includes a feed to one of the stacked antennas.

FIG. 7 illustrates another embodiment of the present invention wherein antenna system 10 includes a feed $\mathbf{21}_m$ to antenna $A_m$. The other antenna $A_i$, where $(1 \leqq i \leqq m-1)$ do not have feeds, and serve as parasitic elements to increase the bandwidth of antenna $A_m$.

The invention may also be characterized as a wideband antenna system that comprises a stack of m antennas, where m is a positive integer, and $m \geqq 2$. Each antenna includes: a) an electrically insulating substrate, b) opposed first and second radio frequency elements mounted to the substrate; c) a ground feed electrically connected to the first radio frequency element: d) an excitation feed electrically connected to the second radio frequency element: and e) a ground plane mounted to the substrate of the $m^{th}$ antenna. The radio frequency elements of each antenna collectively have a unique total area and are mounted to the electrically insulating substrate. The radio frequency elements of the $i^{th}$ antenna provide a ground 12 plane for the $k^{th}$ antenna, where i and k are positive integers, $1 \leqq k \leqq (i-1)$, and $2 \leqq i \leqq m$. The total area of the first and second radio frequency elements of the $i^{th}$ antenna is greater than the total area of the first and second radio frequency elements of the $k^{th}$ antenna.

Obviously, many modifications and variations of the present invention are possible in light of the above teachings. It is therefore to be understood that within the scope of the appended claims, the invention may be practiced otherwise than as specifically described.

We claim:

1. A wideband antenna system, comprising:

a stack of m antennas, where m is a positive integer, $m \geqq 2$, and each of said antennas includes:

an electrically insulating substrate;

opposed first and second radio frequency elements that have a unique total area and are mounted to said electrically insulating substrate such that said radio frequency elements of an $i^{th}$ antenna of said stack provide a ground plane for an $k^{th}$ antenna of said stack, where i and k are positive integers, $1 \leqq k \leqq (i-1)$, $2 \leqq i \leqq m$, and said total area of said first and second radio frequency elements of said $i^{th}$ antenna is greater than said total area of said first and second radio frequency elements of said $k^{th}$ antenna;

a ground feed electrically connected to said first radio frequency element;

an excitation feed electrically connected to said second radio frequency element; and a ground plane mounted to said substrate of an $m^{th}$ antenna of said stud.

2. The antenna system of claim 1 wherein said antennas are each a bow tie antenna.

3. The antenna system of claim 1 further including a frequency selective surface mounted to said stack.

4. A wideband antenna system, comprising:

a support structure;

multiple antenna stacks mounted to said support structure, each said antenna stack having a unique field of view and including m antennas, where m is a positive integer, $m \geqq 2$, and each antenna includes:

an electrically insulating substrate;

opposed first and second radio frequency elements that have a unique total area and are mounted to said electrically insulating substrate such that said radio frequency elements of an $i^{th}$ antenna of said stack provide a ground plane for an $k^{th}$ antenna of said stack, where i and k are positive integer indices, $2 \leqq i \leqq m$, $1 \leqq k \leqq (i-1)$, and said total area of said first and second radio frequency elements of said $i^{th}$ antenna is greater than said total area of said first and second radio frequency elements of said $k^{th}$ antenna;

a ground feed electrically connected to said first radio frequency element; and an excitation feed electrically connected to said second radio frequency element; and a ground plane mounted to said substrate of an $m^{th}$ antenna of said stack.

5. The antenna system of claim 4 wherein said support structure is arcuate shaped.

6. The antenna system of claim 4 wherein said antenna stacks are mounted to said support structure in a radial pattern about said support structure.

7. The antenna system of claim 4 further including a frequency selective surface mounted to each of said antenna stacks.

* * * * *